US006929508B1

(12) United States Patent
Holland

(10) Patent No.: US 6,929,508 B1
(45) Date of Patent: Aug. 16, 2005

(54) COAXIAL CABLE CONNECTOR WITH VIEWING WINDOW

(76) Inventor: Michael Holland, 107 Via Del Cielo, Santa Barbara, CA (US) 93109

( * ) Notice: Subject to any disclaimer, the term of this patent is extended or adjusted under 35 U.S.C. 154(b) by 0 days.

(21) Appl. No.: 10/813,848

(22) Filed: Mar. 30, 2004

(51) Int. Cl.[7] ..... H01R 9/05
(52) U.S. Cl. ..... 439/579
(58) Field of Search ..... 439/578–585

(56) References Cited

U.S. PATENT DOCUMENTS 4,624,525 A * 11/1986 Ichimura et al. ..... 439/596
5,195,910 A * 3/1993 Enomoto et al. ..... 439/578
6,454,613 B2 * 9/2002 Valceschini ..... 439/701

* cited by examiner

*Primary Examiner*—Michael C. Zarroli
(74) *Attorney, Agent, or Firm*—Michael G. Petit

(57) ABSTRACT

A male compression-type coaxial cable connector having a leading end, a trailing end and integral construction is described. The connector includes a nut at the leading end of the connector that is adapted to matingly engage an F, BNC, SMB, MCX or RCA-type female connector. The connector also has a tubular shank, a slotted body portion concentrically mounted to overlie the tubular shank and a compression sleeve slidably attached to the slotted body portion the compression sleeve being disposed on the trailing end of the connector. The trailing end of the connector has an axial conduit therein concentrically disposed around the tubular shank. When the prepared end of a coaxial cable is inserted into the trailing end of the axial conduit and fully advanced into the axial conduit, subsequent advancement of the compression sleeve over the slotted body portion, with the assistance of a compression tool, compresses the cable jacket and braid providing secure attachment. The elongate slots in the body portion provide a viewing window that enables an installer to visually determine when the prepared end of the cable is fully inserted into the axial conduit prior to compression.

1 Claim, 5 Drawing Sheets

COAXIAL CABLE CONNECTOR WITH VIEWING WINDOW

BACKGROUND OF THE INVENTION

1. Field of the Invention

The present invention relates to male coaxial cable connectors operable for electrically connecting a coaxial cable to a mating female port, and, more particularly, to a male coaxial cable connector having a viewing port to enable the installer to visually determine when the prepared end of a coaxial cable is fully inserted into the connector prior to the attachment of the cable thereto.

2. Prior Art

Connectors adapted to form a secure, electrically conductive connection between a coaxial cable and a threaded female port have been developed. Such prior art connectors are discussed, for example, in U.S. Pat. No. 6,217,383 to Holland et al., U.S. Pat. No. 6,676,446, U.S. Pat. No. 6,153,830 and U.S. Pat. No. 6,558,194 to Montena, U.S. Pat. No. 5,024,605 to Ming-Hua, U.S. Pat. No. U.S. Pat. No. 4,280,749 to Hemmer, U.S. Pat. No. 4,593,964 to Forney, Jr. et al., U.S. Pat. No. 5,007,861 to Stirling, U.S. Pat. No. 5,073,129 to Szegda, U.S. Pat. No. 3,710,005 to French and U.S. Pat. No. 5,651,699 to Holliday. U.S. Pat. No. 5,879,191 to Burris, discusses prior art efforts to provide a coaxial connector which is moisture-proof and minimizes radiative loss of signal from the cable. A radial compression type of coaxial cable connector of the type generally used today, is described in detail in U.S. Pat. No. 5,632,651 to Szegda, and the disclosure of Szegda '651 relating to radial compression coaxial cable connectors is incorporated herein by reference thereto.

While the innovative plethora of prior art connectors, some of which are disclosed above, provide improved moisture sealing and/or RF leakage characteristics, all have inherent limitations. For example, the integrity of the attachment between the cable and connector is "craft sensitive", depending on the skill of the installer. The steps required in order to provide a secure, sealing engagement between a connector and a coaxial cable include opportunities for installation errors to occur. Installation of a coaxial cable connector on a coaxial cable requires that the end of the cable first be prepared to receive the connector. The connector is then manually forced onto the prepared end of the cable until the protective jacket and underlying conductive braid of the cable are separated from the dielectric core of the cable. The cable is further advanced into the connector by hand, which requires the application of substantial force by the installer, until the correct depth of insertion is attained. Finally, the connector is securely affixed to the cable by compressing the connector, again by hand, with a compression tool.

With most prior art connectors, during the compression step, the cable jacket and conductive braid are compressed against an annular barb disposed on the outer surface of an underlying tubular shank during the final several millimeters of compressive travel. If the installer fails to completely compress the connector, especially in the final 20 percent of the compressive range, the connector may come loose. In addition, if the cable is not fully inserted into the conduit, the connector may come loose and/or the electrical connection may fail.

In the case of F-type connectors, the prepared end of the cable is usually visible through the connector nut. In the case of BNC, SMB, MCX, RCA and other connectors, the trailing end of the connector nut is sealed and the prepared end of the cable (i.e., the portion of the prepared end that includes the exposed portion of the dielectric core) is not visible when inserted into the connector conduit. The correct positioning of the cable within the connector prior to attachment of the connector to the cable is done by "feel". The skilled artisan will appreciate that it would be an advancement in the art to provide a male coaxial cable connector, particularly a connector operable for attachment to BNC and RCA-type female fittings, wherein the correct positioning of the prepared end of the cable within the connector conduit can be verified by visual inspection prior to the compression step.

SUMMARY

It is a first object of the invention to provide a male coaxial cable connector that includes window means operable for visually observing the position of a prepared end of a coaxial cable within the axial conduit of the male coaxial connector prior to the attachment of the cable to the male coaxial cable connector.

It is another object of the invention to provide a male coaxial cable connector that meets the above-stated objective and is of integral construction, having no separable parts.

The present invention provides a compression-type coaxial cable connector meeting the objectives of the invention. The connector, in accordance with a preferred embodiment of the present invention, is of integral construction and includes a connector nut having a leading end and a trailing end, a tubular shank, a slotted body portion and a compression sleeve. The connector nut is tubular, having a cylindrical inner cavity forming a conduit with a first diameter. The connector nut has female fitting engaging means operable for releasably engaging an F-type, BNC, RCA or other female fitting as appropriate. The tubular shank is an elongate, generally cylindrical tube having a leading end with a flange thereon, and a trailing end. The flange is disposed within the conduit of the nut with the trailing end, which includes an annular barb disposed circumferentially thereon, projecting rearwardly through the trailing end of the connector nut. In some connectors, the flange on the leading end of the tubular shank may be attached to the trailing end of the nut.

The slotted body portion serves two purposes. First, the slotted body portion acts cooperatively with the compression sleeve to provide at least one, or, more preferably, two points of radial compression of the outer jacket and conductive braid of the cable; a first point being disposed between the slotted body portion and the tubular shank, and a second point disposed between the compression sleeve and the barb on the tubular shank as will be discussed below. Second, the slot(s) on the body portion extend forwardly from the trailing end of the body portion and provide a viewing window to determine, visually, when the prepared end of a coaxial cable is fully inserted into the connector prior to attachment thereto. The slotted body portion is an elongate member having a substantially cylindrical leading end, a forked or bifurcated trailing end and an axial conduit coextensive with substantially the length thereof. The diameter of the axial conduit within the slotted body portion is stepped, having a smaller diameter in the leading end than in the trailing end. The trailing end of the wall of the axial conduit is slotted longitudinally and preferably has a plurality of annular gripping ridges thereon. The slot(s) extend forwardly from the trailing end of the body portion to a point that coincides with the leading end of either the dielectric core or the braided shielding on the cable when the cable is fully inserted into the connector. The tubular leading end of the slotted body portion is compression fitted to an annular shoulder on the tubular shank, the shoulder being disposed rearward of the trailing end of the connector nut, to concentrically overlie the tubular shank. A trailing portion of the tubular shank extends rearwardly from the trailing end of the slotted body portion, the extended portion including the relatively low profile annular barb disposed near the trailing end of the tubular shank.

As mentioned above, the tubular shank includes a shoulder adjacent the leading end thereof disposed rearward of the flange. When the stepped inner diameter of the leading end of the conduit within the slotted body portion is compression fitted to the shoulder on the tubular shank, the slotted body portion is prevented from moving with respect to the tubular shank and the nut is rotatably mounted on, and locked to, the tubular shank/connector body assembly. After the slotted body portion is compression fitted to the shoulder of the tubular shank, the nut, a first optional "O" ring, the tubular shank and the slotted body portion are locked into a subassembly having integral construction. The slotted trailing end of the slotted body portion preferably has three annular grooves and one annular ridge on the outer surface thereof. The first, forwardmost annular groove houses a second (optional) "O" ring. The annular ridge on the outer surface of the body portion is diposed rearwardly of the first annular groove between the second and third annular grooves. The third, rearwardmost annular groove provides means for slidably or rotatably attaching a compression sleeve to the aforesaid subassembly.

The compression sleeve is a substantially cylindrical member having a leading end, a trailing end and an axial conduit coextensive with the length thereof. The diameter of the axial conduit within the compression sleeve is stepped in three stages, with the largest diameter at the leading end of the conduit and the least diameter at the trailing end of the conduit. The leading end of the compression sleeve conduit has an annular ridge projecting radially inwardly from the wall of the axial conduit. When the leading end of the compression sleeve is advanced forwardly over the trailing end of the slotted body portion, the annular ridge within the conduit of the compression sleeve engages the third, rearwardmost groove on the slotted body portion to form a compressible coaxial cable connector assembly having integral construction.

When the prepared end of a coaxial cable is inserted into the trailing end of the compression sleeve conduit, and advanced forwardly through the slotted body portion, the trailing end of the tubular shank forces the cable jacket and braid over the relatively low profile barb into an annular space between the shank and the body portion to overlie the tubular shank forward of the barb as well as over the barb. The cable is further advanced into the connector until the leading end of the braided shielding underlies the forward end of the slot as can be determined visually. When it is determined, by visual inspection, that the prepared end of the coaxial cable is fully advanced into the conduit within the body portion, advancement of the compression sleeve over the body portion compresses the cable jacket in two places: (a) between the compression sleeve and the barb on the tubular shank; and (b) between the tubular shank and the gripping ridges within the conduit of the slotted body portion. Further advancement of the compression sleeve is terminated when the annular ridge within the conduit of the compression sleeve "snaps" into, and engages, the second, middle groove in the outer surface of the body portion. The cable jacket and braid are radially compressed where they overlie the barb and where they underlie the gripping ridges, as well as over the barb, thereby providing a stable two-point connection.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1A:
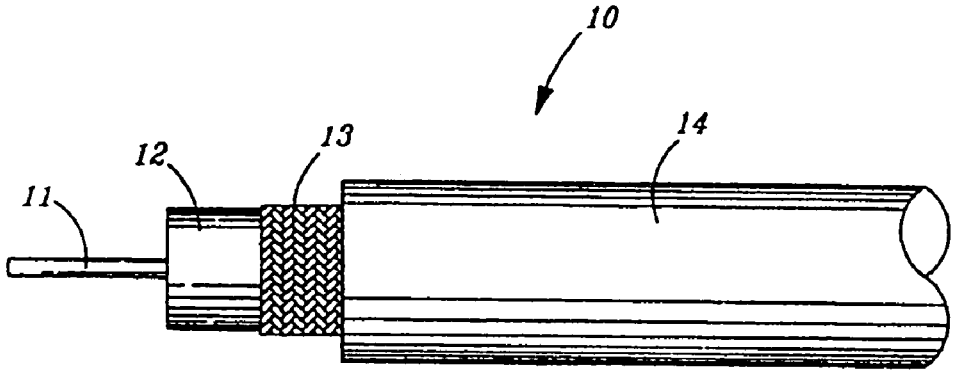
FIG. 1*a* is an elevational view showing the prepared end of a coaxial cable.
Figure 1B:
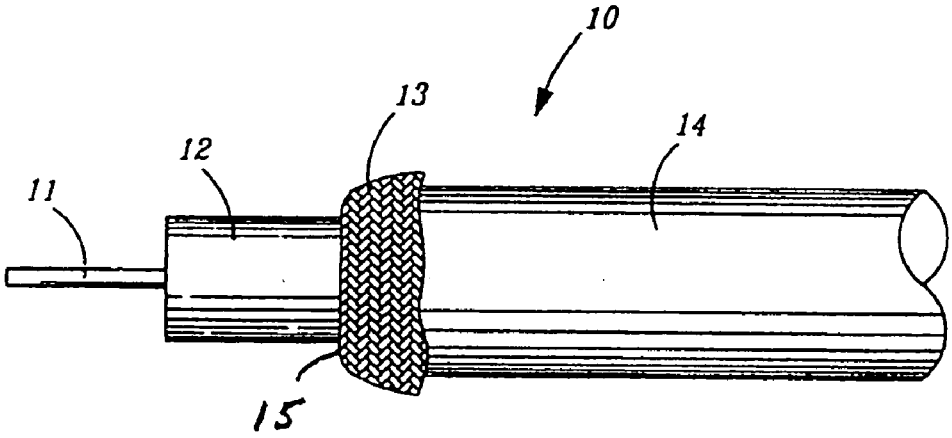
FIG. 1*b* an elevational view showing the prepared end of a coaxial cable illustrated in FIG. 1*a* with the conductive braid folded back to overlie a portion of the protective jacket.

Turning now to FIG. 1*a*, the partially prepared (i.e., stripped) end of a coaxial cable 10 is shown in elevational view. Prior to coupling a coaxial cable to a male connector, the end of the cable to receive the connector must first be prepared. It will be understood by the artisan that the preparation of the end of the cable will be in accordance with the type of male coaxial cable connector that the cable 10 will be attached to (i.e., F-type, BNC, RCA, etc.). A cutting tool (not shown) is used by an installer to expose a portion of the central conductor 11, a length of the dielectric core 12 and a conductive (grounding) braid 13, as shown in FIG. 1*a*. Again, the respective lengths of each of the elements comprising the coaxial cable 10 that are exposed by the cutting tool will depend on the particular type of male connector to be attached thereto and are in accordance with industry standards. Following exposure of the conductive braid 13, the exposed portion of conductive braid 13 is flared and folded back to overlie the protective jacket 14 as shown in FIG. 1*b*. The thickness of the conductive braid may vary, depending on the manufacturer, and require the application of different amounts of force by the installer in order to correctly position the cable end within the connector prior to attachment.

Figure 2:
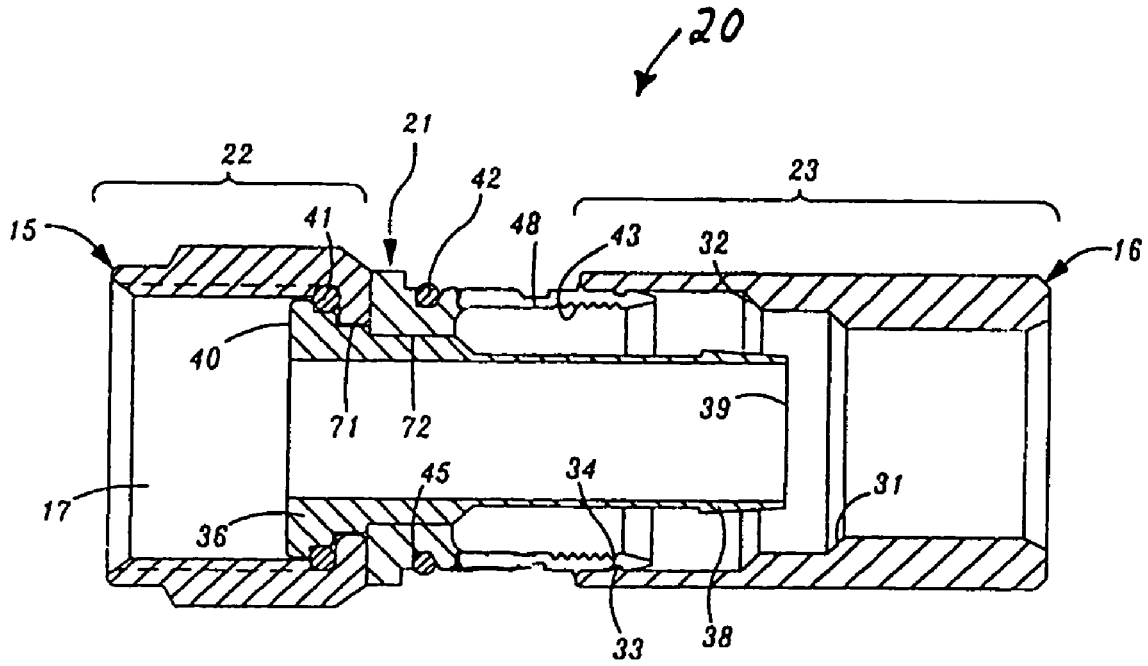
FIG. 2 is a longitudinal cross-sectional view of a coaxial cable connector in accordance with the present invention shown attached to a prepared end of a coaxial cable.

A more or less generic male coaxial cable-connector assembly is shown in cross-sectional view in FIG. 2. For the purpose of illustrating the use of the slotted body portion of the present invention, an F-type coaxial cable connector will be used. It is understood that the advantages of providing a male coaxial cable connector with a viewing port or window in accordance with the present invention is applicable to all male connectors wherein the cable must be correctly positioned within the connector prior to attachment. The connector 20 is a generally cylindrical member having a leading end 15, a trailing end 16 and an axial lumen 17 coextensive with the length thereof (in F-type connectors) and preferably having integral construction. A connector nut 22 forms the leading end of the connector 20 and a compression sleeve 23 forms the trailing end. It will be understood by the artisan that the particular construction of the connector nut 22 will vary in accordance with the type of connector. For example, BNC and RCA-type male connectors have a forwardly projecting pin coaxially mounted on a bulkhead at the trailing end of the connector nut and include seizing means operable for establishing and maintaining electrical connection between the center conductor 11 of the cable and the pin when the prepared end of the cable is inserted into the trailing end of the connector and advanced thereinto. Further, such connector nuts are specially adapted to releasably engage a corresponding female fitting. Accordingly, such connectors are contemplated as being within the scope of the present invention. Again, for simplicity and clarity, an F-type male connector is used herein as an example to demonstrate the advantage of a slotted body member in accordance with the present invention.

The tubular shank 36 has a flange 40 on the leading end thereof and preferably an annular barb 38 on the trailing end thererof. The slotted body portion 21 has a leading end which is compression fit to lockingly engage and grip a shoulder 35 on the tubular shank 36. The compression sleeve 23 has an annular ridge 33 (shown more clearly in FIGS. 3 and 5) on the inner cylindrical conduit, which matingly engages an annular groove 48 (FIG. 4) in the outer surface of the body portion 21. The exposed portion of the conductive braid 13 of the cable 10, and a portion of the protective jacket underlying the (folded back) exposed conductive braid, is housed and compressed within the annular chamber formed between the tubular shank and the overlying body portion and compression sleeve. The position of the leading end 15 of the conductive braid 13 (FIG. 1B) within the axial conduit of the connector 20 can be observed through the slot(s) 61A and 61B (FIG. 2) in the slotted body portion as will be discussed below.

The connector 20 provides two compression points to securely hold the cable such that the central conductor 11 is correctly positioned for engagement with a female receptacle (female fitting not shown). The first or forwardmost cable compression point underlies gripping ridges within the trailing end of the slotted body portion and the second compression point underlies the compression sleeve and overlies the annular barb on the tubular shank. The two compression points, which collectively provide secure attachment between the cable and connector while reducing the diameter or profile of the annular barb 38, are made possible by extending the trailing end of the tubular shank, including the barb, rearward of the trailing end of the slotted body portion to underlie the trailing end 16 of the compression sleeve 23. Preferably, a pair of "O" rings 41 and 42 provide a moisture seal between the nut and tubular shank, and the slotted body portion and compression sleeve respectively.

Figure 3:
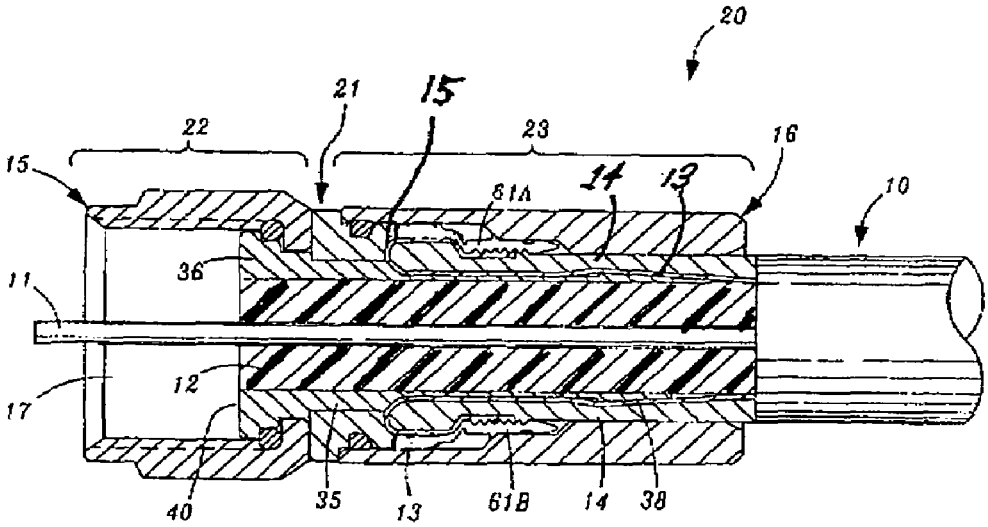
FIG. 3 is a longitudinal cross-sectional view of the coaxial cable connector in accordance with FIG. 2, prior to the insertion of the coaxial cable thereinto.

A cross-sectional longitudinal view of the uncompressed coaxial cable connector 20, illustrating the connector 20 prior to insertion of the prepared end of a coaxial cable thereinto, is shown in FIG. 2. FIG. 3 is a longitudinal cross-sectional view of the connector 20 wherein the connector is attached to the prepared end of a coaxial cable. As mentioned above, the connector 20 is a generally cylindrical member having a leading end 15 and a trailing end 16 and an axial conduit 17 therebetween. The diameter of the opening (in F-type connectors) at the trailing end of the connector nut 22 is dimensioned to snugly accommodate the passage of a first shouder 71 on the tubular shank 36 therethrough. A first "O" ring 41 is preferably interposed between the flange 40 on the leading end of the tubular shank 36 and the trailing end of the nut 22 to provide a moisture seal therebetween. The leading end of the slotted body portion 21 is compression fitted to a second shoulder 72 on the tubular shank and securely attached thereto. The leading end of the conduit within the compression sleeve 23 has an annular ridge 33 therewithin that matingly engages an annular groove 34 on the outer surface of the slotted body portion near the trailing end thereof. The engagement between the annular ridge 33 and groove 34 permits forward movement of the compression sleeve relative to the slotted body portion when a compressive force is applied, but prevents rearward movement when traction is applied.

Figure 4:
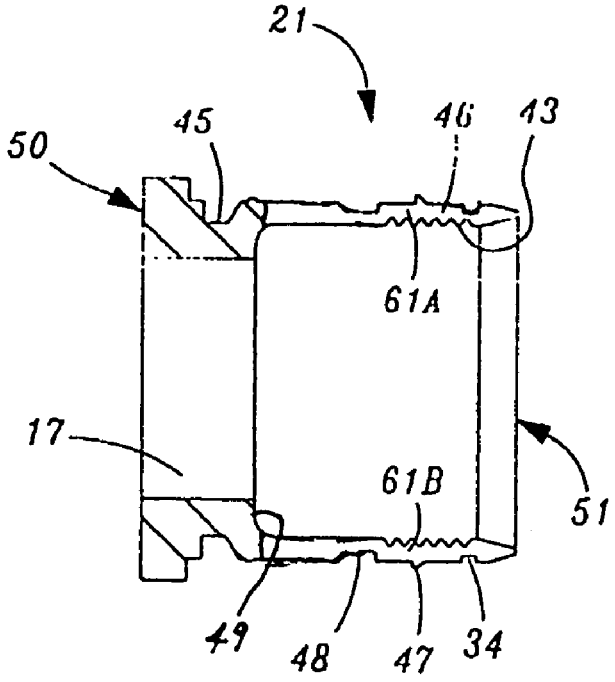
FIG. 4 is a longitudinal cross-sectional view of the slotted body portion of the coaxial coaxial connector of FIGS. 2–3.
Figure 6:
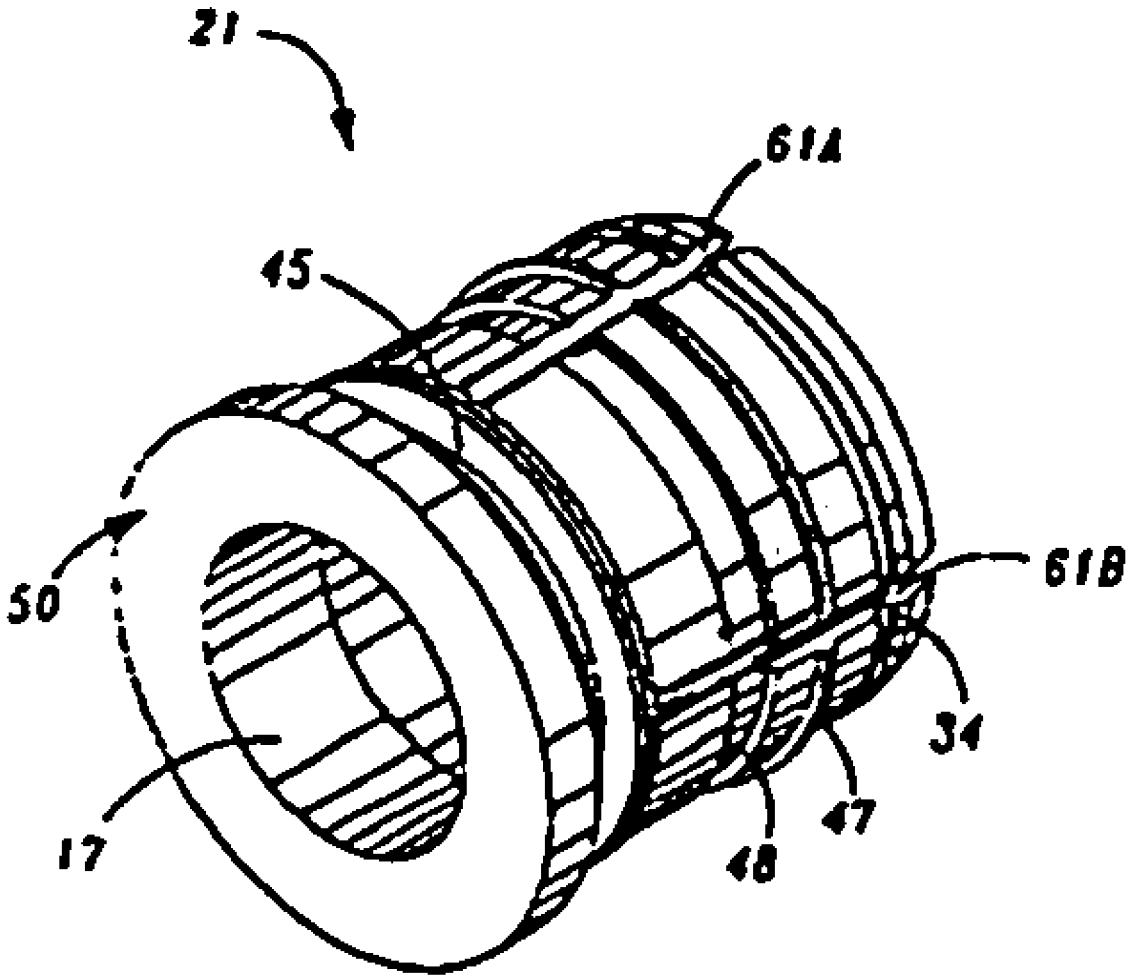
FIG. 6 is a perspective view of the slotted body portion of the connector shown in FIG. 4, viewed more or less from the leading end thereof, illustrating the annular ridge, the slots extending forwardly from the trailing end thereof and a plurality of grooves on the outer surface thereof.

The slotted body portion 21 of the connector 20 is shown in longitudinal cross-sectional view in FIG. 4, and in perspective view in FIG. 6. As stated above, the diameter of the conduit 17 in the leading end 50 of the slotted body portion 21 is dimensioned to compression fit over the second shoulder 72 of the tubular shank, thereby integrating the nut, tubular shank and slotted body portion into a unified subassembly. The outer surface of the slotted body portion 21 includes a first annular groove 34, a second annular groove 48 and an annular ridge 47 therebetween. The inner surface of the axial conduit 17 within the slotted body portion 21 has at least one, and more preferably a plurality, of gripping ridges 43 on the wall thereof, circumfrentially disposed near the trailing end 51 of the slotted body portion. At least one, and, more preferably, a plurality of slots, two of which are shown at 61*a* and 61*b*, in the wall of the slotted body portion, shown more clearly in perspective view in FIG. 6, extend rearwardly from a shoulder 49 to the trailing end 51 of the slotted body portion. The shoulder 49 provides a stop for the leading end 15 of the braid 13 on the cable 10 when the prepared end of the cable is fully inserted into the axial conduit. The slots 61*a* and 61*b* provide viewing window(s) to enable a cable installer to determine when the cable is correctly positioned within the axial conduit because when the cable is correctly positioned within the connector, the braid 13 will underlie the leading end of the slots. The slots 61*a* and 61*b* also permit substantial reduction in the diameter of the trailing end of the slotted body portion when a radially compressive force is applied. Thus, the diameter of the conduit within the slotted trailing end of the slotted body portion can be made larger than if the body portion lacked such slots. The larger (non-compressed) diameter of the conduit in the trailing end of the slotted body portion enables the facile insertion of a variety of coaxial cables having a range of cable diameters thereinto. A second "O" ring 42 (FIG. 3) is preferably disposed within an annular recess 45 near the leading end of the slotted body portion.

Figure 5:
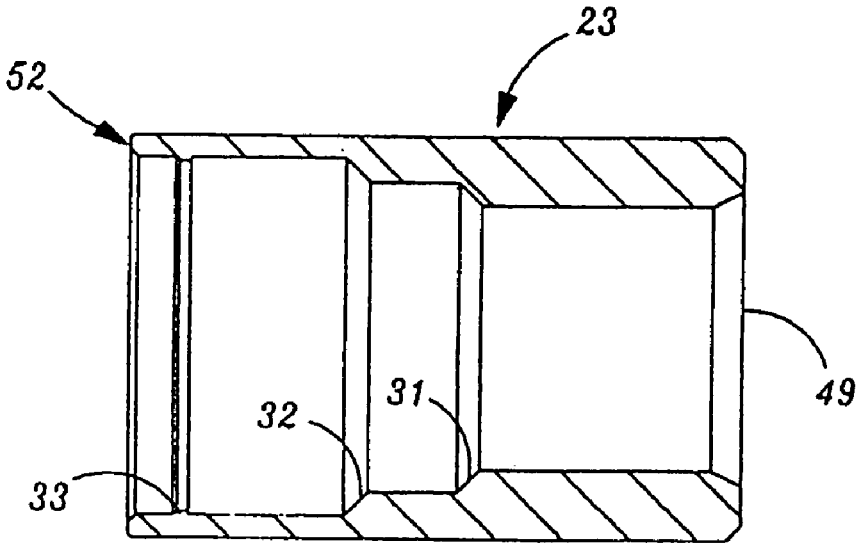
FIG. 5 is a longitudinal cross-sectional view illustrating the compression sleeve of the coaxial coaxial connector of FIGS. 2–3.

The compression sleeve 23 is a cylyindical member having an axial conduit coextensive with the length thereof, the axial conduit 17 having a stepped diameter within the compression sleeve, the steps indicated at numerals 31 and 32 as illustrated in longitudinal cross-sectional view in FIG. 5. The compression sleeve 23 includes an annular ridge 33 disposed circumferentially on the conduit wall adjacent the leading end 52 thereof. When the leading end 52 of the compression sleeve is inserted and advanced over the trailing end 51 of the slotted body portion, the slots 61*a* and 61*b* on the slotted body portion enable the trailing end thereof to be elastically compressed radially inwardly by the step 32 within the compression sleeve when the compression sleeve is advanced. Further advancement of the compression sleeve over the slotted body portion is terminated when the annular ridge 33 engages the rearmost trailing groove 34 on the slotted body portion. The engagement between the ridge 33 and trailing groove 34 prevents retraction of the compression sleeve from engagement with the slotted body portion but permits further advancement of the compression sleeve over the slotted body portion when sufficient force is applied, as, for example, by an installer's compression tool.

In order to attach the connector 20 to a coaxial cable 10, the prepared end of the coaxial cable, as illustrated in FIG. 1B, is inserted into the trailing end 16 of the connector conduit 17 and advanced thereinto until the leading end 15 of the braid 13 abuts the stepped shoulder 49 on the slotted body portion 21 and confirmed by visual inspection through the slot(s). The compression sleeve is then further advanced over the slotted body portion using a suitable compression tool. As the compression sleeve advances, the beveled steps 32 and 31 within the axial conduit of the compression sleeve progressively compress the jacket and braid in two places: (a) between the gripping ridges within the slotted body portion and the outer surface of the tubular shank; and (b) between the compression sleeve and the barb. Compression of the connector is terminated when the annular ridge 33 "snaps" into and engages the forward annular groove 48 in the slotted body portion. The pressure of the compression sleeve on the annular ridge 47 disposed on the outer surface of the slotted body portion urges the gripping ridges 43 against the cable jacket and braid to form a secure connection which supplements the point of attachment provided by the barb and reinforces the attachment of the connector to the coaxial cable.

While particular embodiments of the present invention have been illustrated and described, it would be obvious to those skilled in the art that various other changes and modifications can be made without departing from the spirit and scope of the invention. The critical feature of the present invention is the incorporation of viewing means in the connector operable for observing the forward advancement of a coaxial cable into the connector to visually confirm the correct disposition of the prepared end of the cable within the connector prior to attachment of the connector to the cable. Accordingly, the invention may be used with any coaxial cable connector wherein the correct positioning of the cable within the connector is advantagously visually confirmed prior to attachment of the cable to the connector. It is therefore intended to cover in the appended claims all such changes and modifications that are within the scope of this invention.

What I claim is:

1. In a male coaxial cable connector having an axial conduit, the coaxial cable connector being operable for attachment to a prepared end of a coaxial cable, the prepared end of the coaxial cable being dimensioned for insertion into the axial conduit within the coaxial cable connector, the prepared end thereafter being advanced to a predetermined position within the axial conduit prior to connection of the coaxial cable to the coaxial cable connector, the improvement comprising viewing means disposed on said male coaxial cable connector operable for enabling a cable installer to visually determine when the coaxial cable is correctly positioned within the connector prior to attachment thereto, wherein said male coaxial cable connector comprises a connector nut, a tubular shank extending rearwardly from said connector nut, a slotted body portion overlying said tubular shank, said slotted body portion having an axial conduit with an open trailing end and and a shoulder forward of said trailing end, and a compression sleeve overlying at least a trailing end of said slotted body portion and wherein said viewing means comprises a longitudinal slot in said slotted body portion.

* * * * *